US009082390B2

(12) United States Patent
Chia

(10) Patent No.: US 9,082,390 B2
(45) Date of Patent: Jul. 14, 2015

(54) ACTIVE ACOUSTIC NOISE REDUCTION TECHNIQUE

(76) Inventor: Yin-Hua Chia, San Gabriel, CA (US)

( * ) Notice: Subject to any disclaimer, the term of this patent is extended or adjusted under 35 U.S.C. 154(b) by 728 days.

(21) Appl. No.: 13/436,748

(22) Filed: Mar. 30, 2012

(65) Prior Publication Data

US 2013/0259248 A1 Oct. 3, 2013

(51) Int. Cl.
*G10K 11/16* (2006.01)
*G10K 11/178* (2006.01)

(52) U.S. Cl.
CPC ..... *G10K 11/1784* (2013.01)

(58) Field of Classification Search
CPC ..... H03F 3/68; H03F 3/181; H03F 3/217; H03F 3/72; H03F 2200/03; H03G 3/001; H03G 3/32; H03G 3/3005; H03G 3/3089; H03G 7/007; H03G 3/225; H03G 3/301; H03G 3/3026; H03G 11/00; H03G 11/006; H03G 11/08; H03G 2201/103; H03G 2201/106; H03G 2201/202; H03G 2201/302; H03G 2201/508; H03G 2201/603; H03G 2201/606; H03G 3/20; G10K 11/00; G10K 11/16; G10K 11/178; H03H 21/00; H04R 27/00; H04R 3/02; H04R 1/00; A61B 5/05; H03B 29/00; H04B 15/00; A61F 11/06; H03K 19/003; H04N 7/00
USPC ..... 381/28, 59, 55, 317, 318, 321, 71.1, 381/71.11, 71.14, 74, 83, 332, 93, 96, 97, 381/98, 99, 100, 101, 102, 103, 106, 107, 381/108, 120, 121; 327/551, 552, 553, 555, 327/560; 704/E21.007, E21.02; 379/406.01–406.16; 455/136, 138, 455/219, 239.1, 240.1, 245.1, 247.1, 250.1, 455/251.1
See application file for complete search history.

(56) References Cited

U.S. PATENT DOCUMENTS 4,689,821 A * 8/1987 Salikuddin et al. ..... 381/71.9

* cited by examiner

*Primary Examiner* — Leshui Zhang
(74) *Attorney, Agent, or Firm* — Yang & Wang, P.C.; Elizabeth Yang; Songfong T. Wang

(57) ABSTRACT

An acoustical noise reduction system which comprises a primary acoustic to electric transducer, digital signal processor (DSP), an electric to acoustic transducer, and a secondary acoustic to electric transducer is disclosed in the present invention. The active noise reduction system is located close to the noise source with the sound being sensed by a primary transducer before the noise enters the active noise reduction area. The system functions to generate an anti-noise cancellation sound wave with an acoustic propagation speed of approximately 330 m/sec and an electromagnetic propagation speed of approximately 3×10^8 m/sec.

2 Claims, 11 Drawing Sheets

OPEN AREA PERFORMED IN TIME DOMAIN

Principle of the Invention

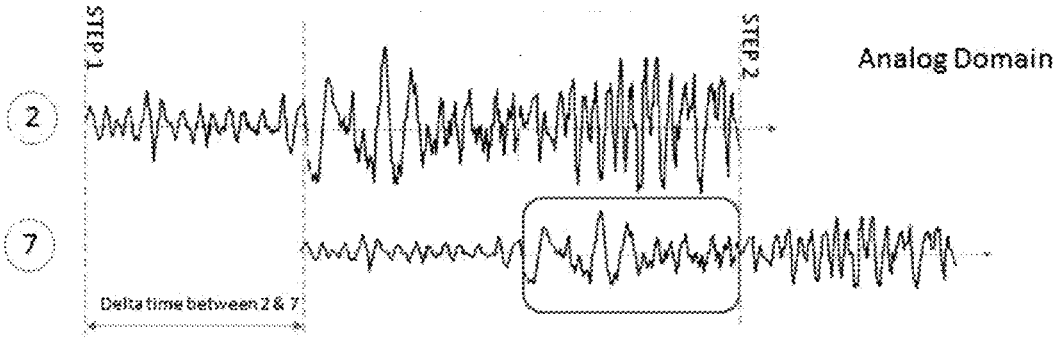

Auto-calibration Procedure:

STEP 1: TIMING CONTROLLER(12) starts the sampling from both transducer(2 and 7), converting both analog signals into digital samples. The samples representing signal from transducer(2) be stored in DUAL PORT RAM(5) from address 0, samples representing signal from transducer(7) be stored in MIC2 SAMPLING STORAGE(10) (using shift registers).
STEP 2: When the advancing of the DUAL PORT RAM(5) reaches the maximum address, TIMING CONTROLLER(12) stops storing on both the DUAL PORT RAM(5) and MIC2 SAMPLING STORAGE(10). Now MIC2 SAMPLING STORAGE(10) shall contain a subset samples stored in DUAL PORT RAM(5). The depth of DUAL PORT RAM(5) shall accomodate the number of samples elapses from the delta time.

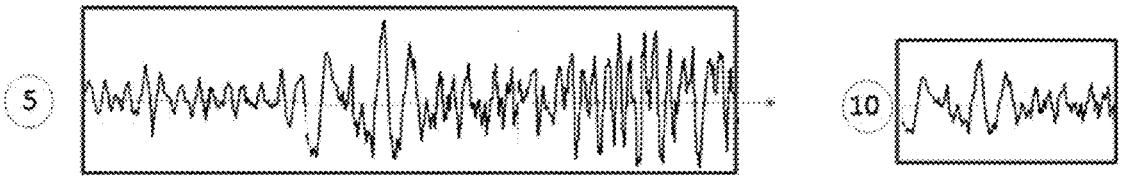

FIG. 9

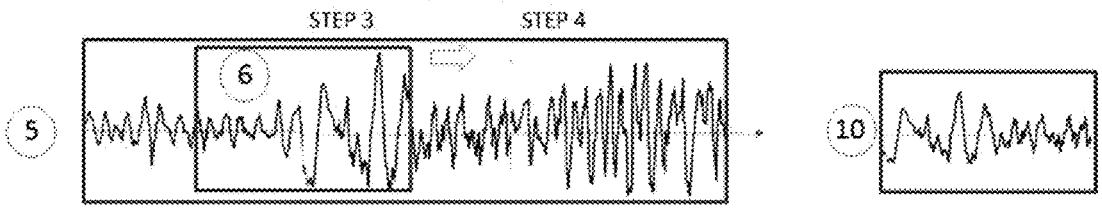

Auto-calibration Procedure:

STEP 3: TIMING CONTROLLER(12) starts loading samples from DUAL PORT RAM(5) into MIC1 SAMPLING STORAGE(6) (also a shift registers). The number of samples in both (6) and (10) are the same.
STEP 4: TIMING CONTROLLER(12) increments the READ LOGIC(14)'s read address, and the samples from DUAL PORT RAM(5) be shifted in the MIC1 SAMPLING STORAGE(6), thus the whole MIC1 SAMPLING STORAGE(6) is moving along the samples in DUAL PORT RAM(5).
STEP 5: MATCH FILTER(11) is running in parallel, and only when the contents in MIC1 SAMPLING STORAGE(6) approximate the contents in MIC2 SAMPLING STORAGE(10), the results of MATCH FILTER(11) exceeds preset threshold level, TIMING CONTROLLER(12) stops incrementing the read address.

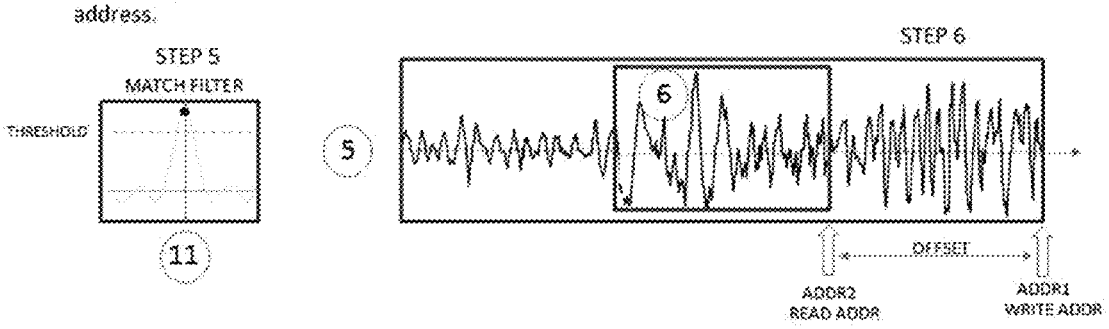

FIG. 10

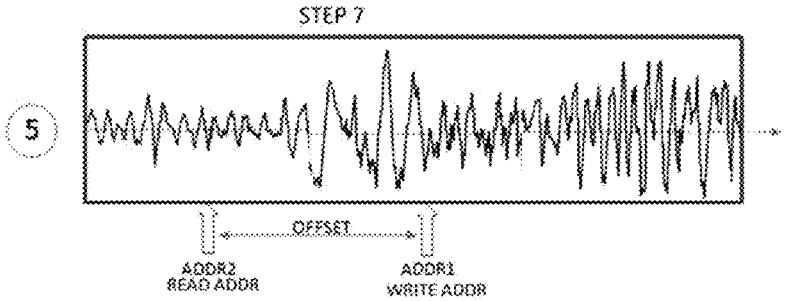

STEP 6: TIMING CONTROLLER(12) now logs the READ ADDRESS and the WRITE ADDRESS applied on the DUAL PORT RAM(5). The OFFSET between two address pointers represents the delta time delay between TANSDUCER(2) and TRANSDUCER(7).

STEP 7: TIMING CONTROLLER(12) now just keeps storing the incoming samples from TRANSDUCER(2), ANTI-ALIAS FILTER(3) and ADC(4) by incrementing write address pointer. READ LOGIC(14) sends read address pointer (ADDR2) with the OFFSET value trailing behind the write address pointer (ADDR1).

STEP 8: Samples out of DUAL PORT RAM(5) feeds DAC(15), then this analog signal be amplified with GAIN AMP(17) with inverted polarity, through TRANSDUCER(18) to cancel aggressor noise.

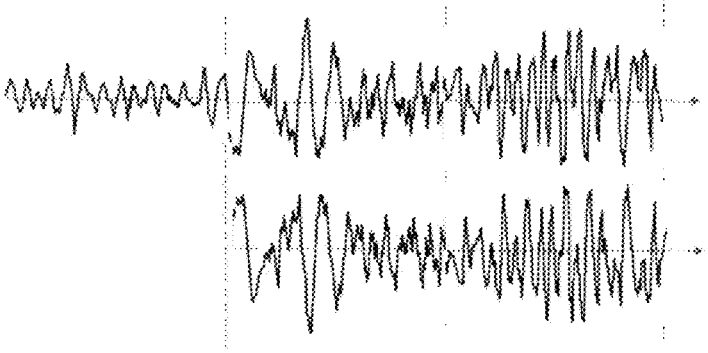

FIG. 11

ACTIVE ACOUSTIC NOISE REDUCTION TECHNIQUE

FIELD OF THE INVENTION

This invention relates to active acoustical noise reduction systems.

BACKGROUND OF THE INVENTION

Formulating practical solutions for the reduction of problematic noise is an active area of engineering research in both the fields of acoustics and control. To date, noise reduction has been mostly carried out using passive means. These passive methods almost always require the installation of heavy, bulky and costly materials such as foams, wools and fibrous bats. The additional weight bulk and physical change required is in many situations neither practicable nor cost effective. Also, one of the fundamental problems with insulators or absorbing materials is that they do not work well at reducing noise at the low frequencies. This is primarily because the acoustic wavelength at low frequencies becomes large compared to the thickness of typical absorbent materials. Furthermore, all existing noise reduction systems utilize the feedback technique in closed environments, which are not ideal for the cancellation of random noise.

For example, U.S. Pat. No. 7,853,024 issued to Slapak et al., discloses an active noise control for controlling a noise produced by a noise source. The prior art's complicated prediction is based on the received signal (noise samples) and does not involve a primary transducer that senses the signal ahead of time to account for the dynamic changes of the random noise.

Active noise reduction can overcome these problems and disadvantages. Active noise reduction is based on the principle of superposition of signals. According to the principle of superposition, if two signals exist, one an undesired disturbance, the other a controlled response, their combined effect can be made zero if they are equal in magnitude and opposite in phase. This signal cancellation phenomenon is commonly termed destructive interference, and is a basis for the operation of active noise reduction systems.

The advantages of active noise reduction are numerous. However, the two most significant relate to the method's spectral effectiveness and method of installation.

Active noise reduction exploits the long wavelengths associated with low frequency sound. Active noise reduction systems are, therefore, more effective at attenuating low frequency acoustic disturbances. Such low frequency disturbances are the common undesired side effect of operating machinery and are difficult to reduce using passive techniques.

In terms of physical implementation, active noise reduction systems typically comprise small and light weight components. This means that active noise reduction systems can be used in many situations where passive methods are impractical due to their bulk, weight and cost effectiveness.

The existing active noise reduction systems still suffer from their own disadvantages, however. These include the risks associated with system stability, less than adequate noise suppression performance and insufficient operating bandwidth.

Active noise reduction systems based on a feedback control approach, for example, risk instability, particularly where the feedback compensator has no means of accounting for change in the dynamic characteristics of the plant. It is difficult to design a feedback compensation network that provides both highly effective and robust noise reduction, particularly over a wide frequency bandwidth. Also, as the feedback compensator's gain is increased to improve low frequency noise suppression, amplification at the higher frequencies typically impacts negatively on performance.

Active noise reduction systems based on the known adaptive feed-forward technique, for example, can experience problems with effective parameter convergence and therefore provide less than optimal performance. Adaptive techniques also require intensive processing particularly where the feed-forward path dynamics are complex and the time available to compute a control response is brief. In many cases this makes this method of control unfeasible due to cost or the inability to implement the system practically.

SUMMARY OF THE INVENTION

It is a main purpose of this invention to provide for optimal noise reduction capabilities for a variety of noise fields without the use of any feedback technique. The present invention is an active acoustic noise reduction system that comprises sensors at a distance near the source of the noise, which feeds the sampled noise in the electrical media to the main system. In one embodiment, these sensors could be in the form of a microphone, piezo, motion sensor, etc. In another embodiment, the electrical media could be wired or wireless. The system takes advantage of the received electrical noise signal a delta time ahead of the arrival acoustic noise, thus utilizing an appropriate self-adjusting timing process to cancel the noise with out-of-phase acoustical energy.

BRIEF DESCRIPTION OF THE FIGURES

The invention can be better understood with reference to the following figures. The components in the figures are not necessarily to scale, emphasis instead being placed upon illustrating the principles of the invention. Moreover, in the figures, like reference numerals designate corresponding parts throughout the different views.

FIG. 9 is a schematic block diagram depicting steps 1-2 of an auto-calibration procedure;

FIG. 10 is a schematic block diagram depicting steps 3-6 of an auto-calibration procedure; and FIG. 11 is a schematic block diagram depicting step 7 of an auto-calibration procedure.

DETAILED DESCRIPTION

Some embodiments of the present invention are described in detail with reference to the related drawings of FIGS. 1 through 5. Additional embodiments, features and/or advantages of the invention will become apparent from the ensuing description or may be learned by practicing the invention.

Figure 1:
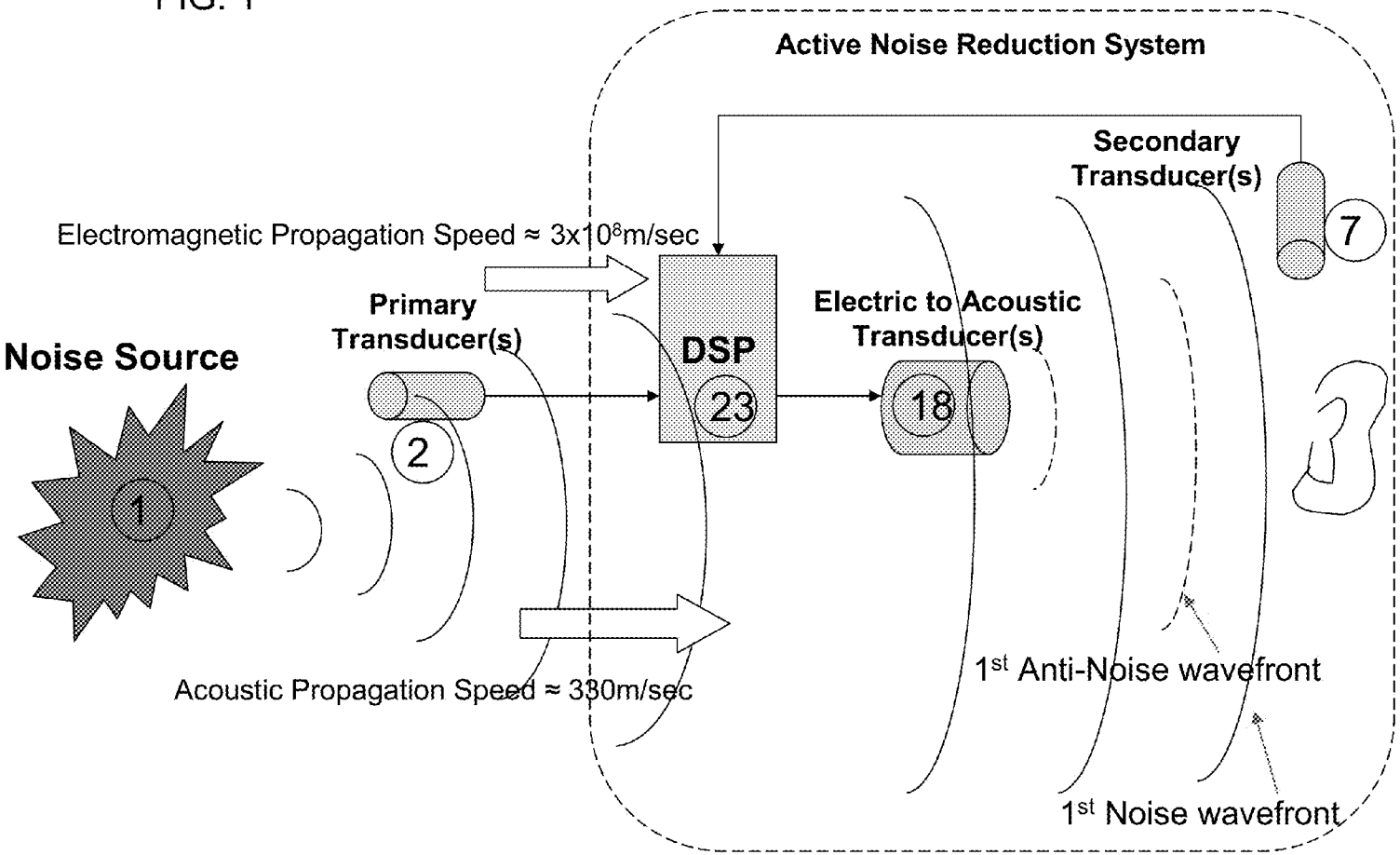
FIG. 1 generally shows one embodiment of the active noise reduction system.

FIG. 1 generally shows one embodiment of the active acoustic noise reduction system 100. A noise source 1 at the beginning of the diagram is sensed by the primary transducer 2, which then feeds the sampled noise, in the form of an input signal 102, through either wired or wireless means into a digital signal processor (DPS) within the main system. The DSP 23 then feeds into an electric to acoustic transducer 18. The acoustic propagation speed of the noise is approximately 340 m/sec, which correlates to the sound wave that is being cancelled. It is significant to note that the present invention addresses sound waves, and not electromagnetic waves, as the aforementioned 340 m/sec indicate. The system takes advantage of the received electrical noise signal a delta time ahead of the arrival acoustic noise, thus generating a process to cancel the noise with out-of-phase acoustical energy. The system functions to generate an anti-noise cancellation sound wave.

Figure 2:
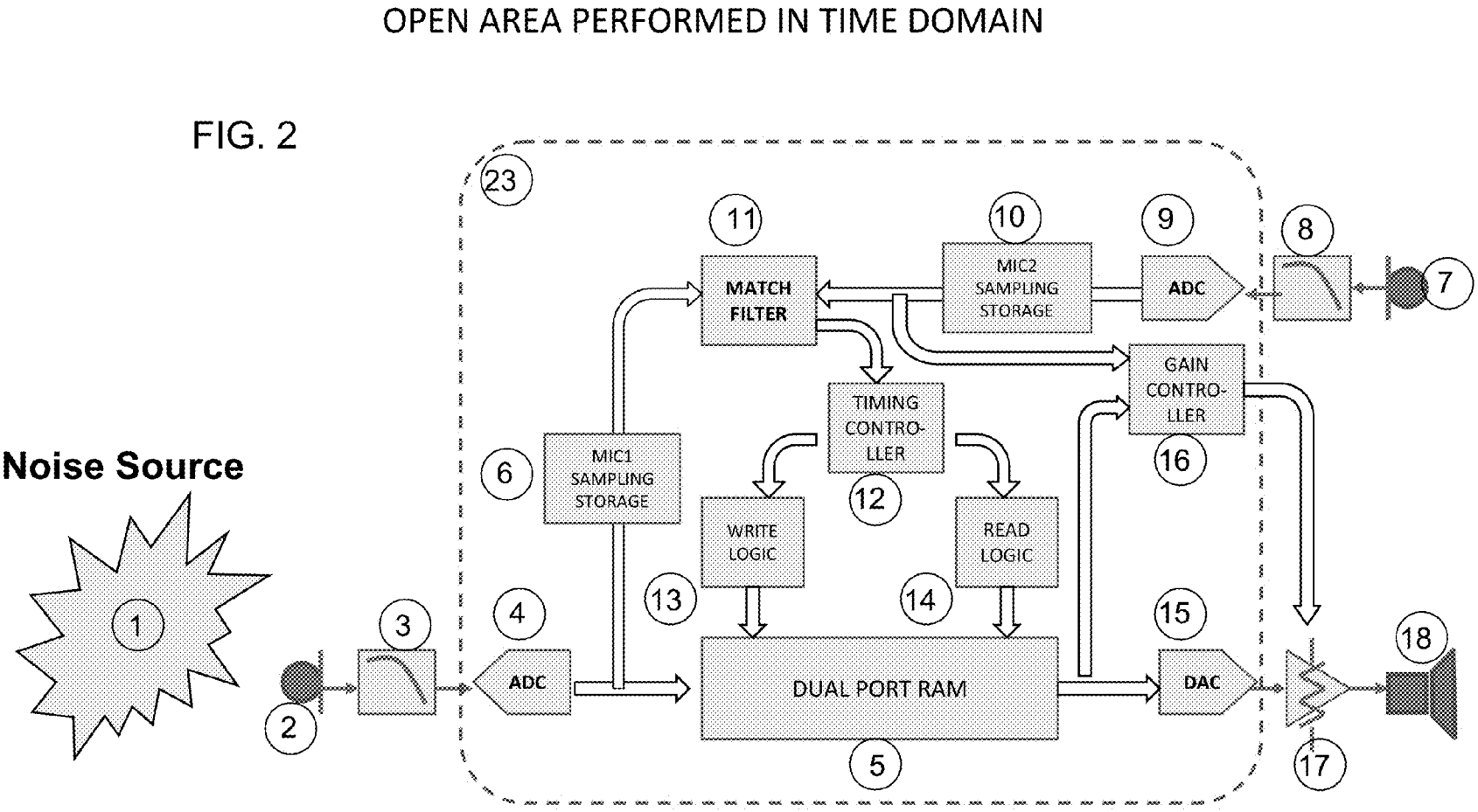
FIG. 2 is a schematic block diagram depicting one embodiment of an active noise reduction system with a direct noise source input with no interference.

Referring to FIG. 2, a more schematic block diagram of the active noise reduction system is shown. Similar to FIG. 1, a noise source 1 at the beginning of the diagram is sensed by the primary transducer 2, which then feeds the sampled noise through either wired or wireless means into the main system. Within the system, the noise passes through an anti-aliasing filter 3 before entering into an Analog-to-Digital converter 4. The converted noise signal in digital format is sent continuously to a dual port RAM 5, the main storage, which then wraps around when the write address reaches the end location. The number of the addresses of the main storage, dual port RAM 5, shall be big enough to accommodate up to a few seconds worth of noise samples.

A specific depth of sampling storage 6 (bank of shift registers) scans through the entire main storage 5, and its output is used to run convolution in the match filter 11. As illustrated in the double arrow of FIG. 2, the sampling storage 6 scans and reviews at least a portion of the converted noise signal in digital format that is transmitted to the main storage 5. The same noise signal propagates acoustically and is sensed by the secondary transducer 7 placed at the near field, which feeds the local (delayed) noise through either wired or wireless means into the main system.

A fixed amount of converted noise samples in digital format can be stored in sampling storage 10 (smaller bank of shift registers). The outputs of both storages 6 and 10 undergo convolution in the match filter 11, which synchronizes the stored sample gathered in the primary transducer 2 to the truncated signal from the secondary transducer 7 in time domain.

The timing control logic 12 then determines the delta time between 2 and 7, in terms of offset in address count, for the dual port RAM 5. While the noise sample from primary transducer 2 is consistently written into main storage 5 by the write logic 13, the output of the dual port RAM 5 is then accessed with the read logic 14 lagging with the offset derived from the match filter 11. Both the write logic 13 and the read logic 14 advance with the same clock, so the output of the main storage 5 shall align with the signal received at the secondary transducer 7. The actual offset used in the device accounts for all the circuits' delay.

The acoustic energy of the noise source 1 received at secondary transducer 7 shall be much attenuated from the signal received at primary transducer 2, due to the field energy is reciprocal to square of distance. There is a gain ratio estimator 16, which takes the outputs of main storage 5 and sampling storage 10, and compares their gain ratio from accumulating positive signal samples in fixed time duration. The derived ratio feeds into the gain setting device 17, which drives the transducer 18. The transducer 18 converts the electrical energy into acoustic energy with inverted polarity. Thus the acoustic output of this device is aligned with the incoming noise but in opposite phase, in order to cancel out the incoming noise.

As referenced in FIGS. 9-11, the speed of the sound wave changes with temperature and humidity, so the device has to calibrate the time alignment periodically. Below is the sequence of events for calibration:

Step 1: Gauge the delta time t1 between the primary transducer 2 and the secondary transducer 7 by turning off the transducer 18, so that there is only an acoustic signal from noise source 1 between the primary transducer 2 and the secondary transducer 7. The delta t1 will be implemented in offset between the write address and the read address of the Dual Port RAM 5.

Step 2: The timing control logic 12 initiates writing converted samples on both 6 and 10 sampling storages, while storage 10 is shorter and wraps around when the counter reaches its end location. Timing control logic stops writing on both storage when sampling storage 6 reaches its capacity.

Step 3: The timing control logic 12 starts convolution by sliding the samples in storage 6 to run multiplication and accumulation on each sample taps in storage 10, and generates a series of the product terms in separate storage in match filter 11.

Step 4: Match filter 11 looks for the greatest value in the product terms, and use the corresponding index as the max point. The offset value of delta t1 is M+N−max point, where M is the length of the storage 6, N is the length of the storage 10, and max point is the index of the greatest product in separate storage in match filter 11.

Steps 5-10 illustrate the process of calibration between the MIC2 storage 10 and the transducer 18.

Step 5: Gauge the delta time t2 between the secondary transducer 7 and transducer 18, by switching off the primary transducer 2 and replaying the stored samples in storage 6, from Steps 1 through 4. The secondary transducer 7 picks up the reproduced sound from transducer 18.

Step 6: The timing control logic 12 initiates writing converted samples from the secondary transducer 7 to storage 10, while reading through storage 6. The storage 10 is shorter and wraps around when the counter reaches its end location. The timing controller calculates the correct timing in terms of the reading address offset from the writing address by stopping any writing to the storage 10 when storage 6 reaches its end point.

Step 7: The timing control logic 12 starts convolution by sliding the samples in 6 to run multiplication and accumulation on each sample taps in storage 10, and generates a series of the product terms in separate storage in match filter 11.

Step 8: Match filter 11 looks for the greatest value in the product terms, and uses the corresponding index as the max point. The offset value of delta t2 is M+N−max point, where M is the length of the storage 6, N is the length of the storage 10, and max point is the index.

Step 9: Gauge the gain ratio between the primary transducer 2 and secondary transducer 7 with gain controller 16. The gain controller takes the outputs of main storage 5 and the storage 10, already aligned in the time domain and compares their magnitude ratio from accumulating positive signal samples in fix time duration. The ratio will be applied to the output of the main storage 5, before entering into the Digital-to-Analog Converter (DAC) 15.

Step 10: The system uses the delta time t1 and delta time t2, plus the ratio into the resulting anti-phase noise signal. All these parameters account the process delay of all the specific hardware, trying to achieve the best approximation to cancel the incoming random noise. Every calibration step is executed in a preset time interval, event triggered, or user override mode in order to account for environmental changes (e.g., temperature, humidity etc).

Figure 3:
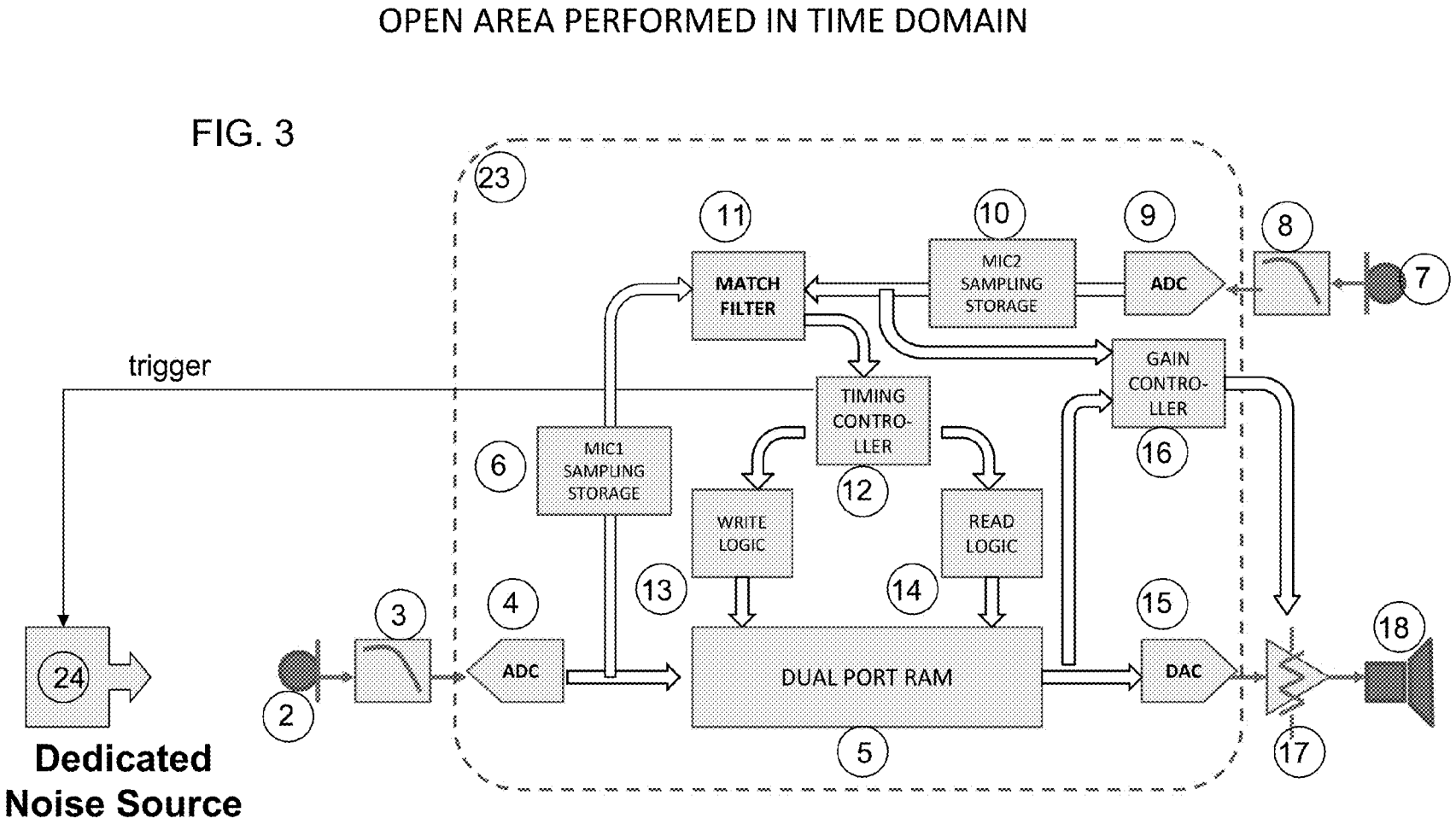
FIG. 3 is a schematic block diagram depicting one alternative embodiment of an active noise reduction system with a direct noise source input with no interference.

Sometimes, the noise to be cancelled is periodic with Fourier harmonics in nature, and it is not practical to use a match filter to synchronize the controlled response to the incoming undesired disturbance. A dedicated signal source 24 as depicted in FIG. 3 with a pre-determined random pattern encoded in acoustic bandwidth is necessary to calibrate the invention. Such a device produces a burst of noise through the primary transducer 2 and the secondary transducer 7, triggered by the timing controller 12. Steps 1 through 10 are then performed to gauge the delta time t1 between the primary transducer 2 and the secondary transducer 7. This method does not need to be performed in a controlled environment, as this special burst of noise can be superimposed in the existing background noise. The uniqueness of the random noise increases the effectiveness of the match filter 11.

Figure 4:
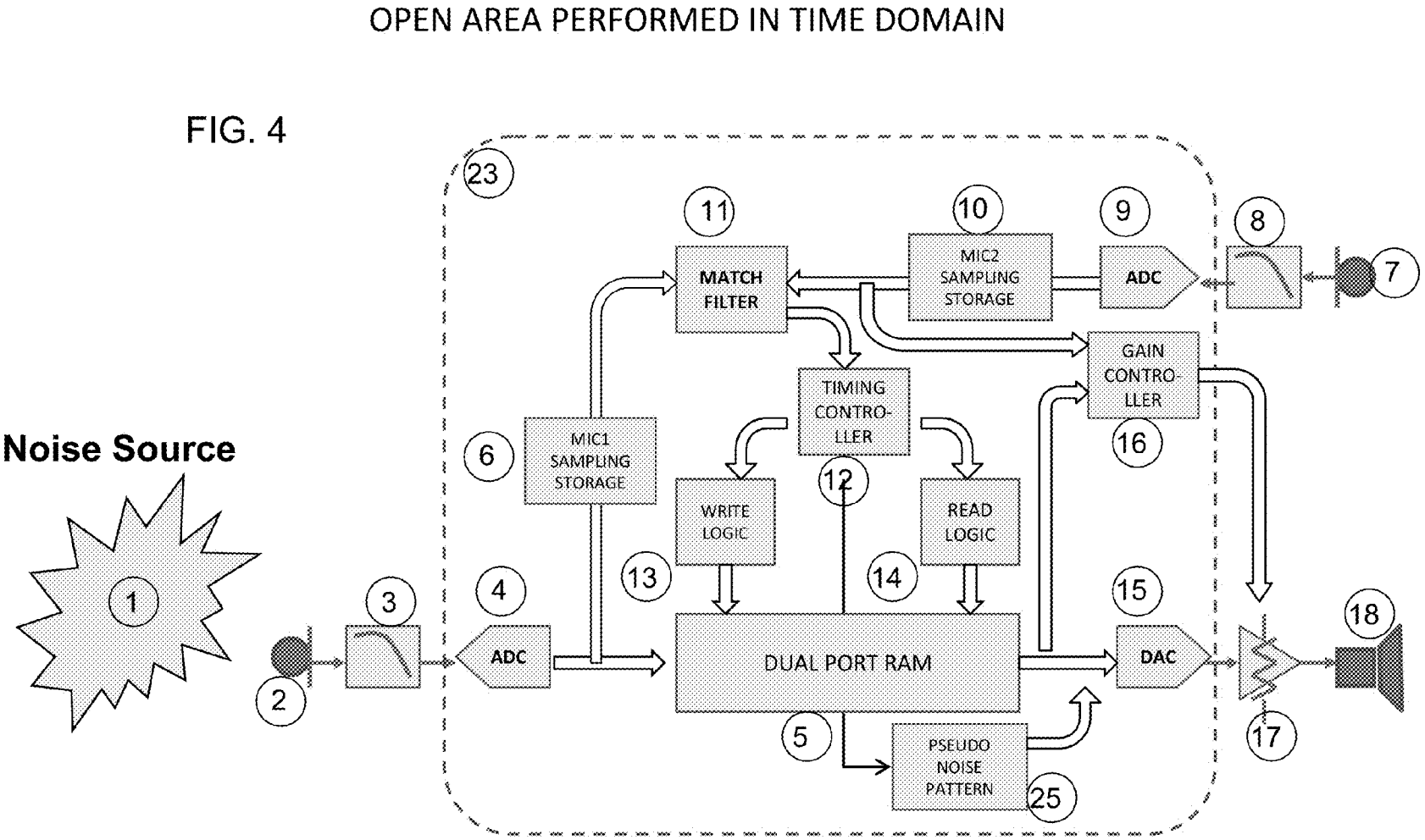
FIG. 4 is a schematic block diagram depicting another possible embodiment of an active noise reduction system with a direct noise source input with no interference.

The dedicated signal source 24 in FIG. 3 can be replaced by transducer 18 to calibrate the invention. The burst of noise can be generated from an embedded Pseudo Noise Generator 25 as shown in FIG. 4, triggered by the timing controller 12. In this measurement the transducer 7 receives the pre-defined acoustic pattern from transducer 18 with a delta time t1 ahead of transducer 2. The invention undergoes Steps 1 through 10 to gauge the delta time t1. The uniqueness of the random noise increases the effectiveness of the match filter 11.

In practical applications, there are certain types of physical boundaries between the primary transducer 2 and the rest of the system, including but no limited to a wall, building, bushes, etc, and the acoustic noise travels through the boundary would be altered in frequency domain. In most cases, the transfer function is more similar to a low pass filter with attenuation, and the above system implemented in time domain is adequate enough to cancel the random noise.

Figure 5:
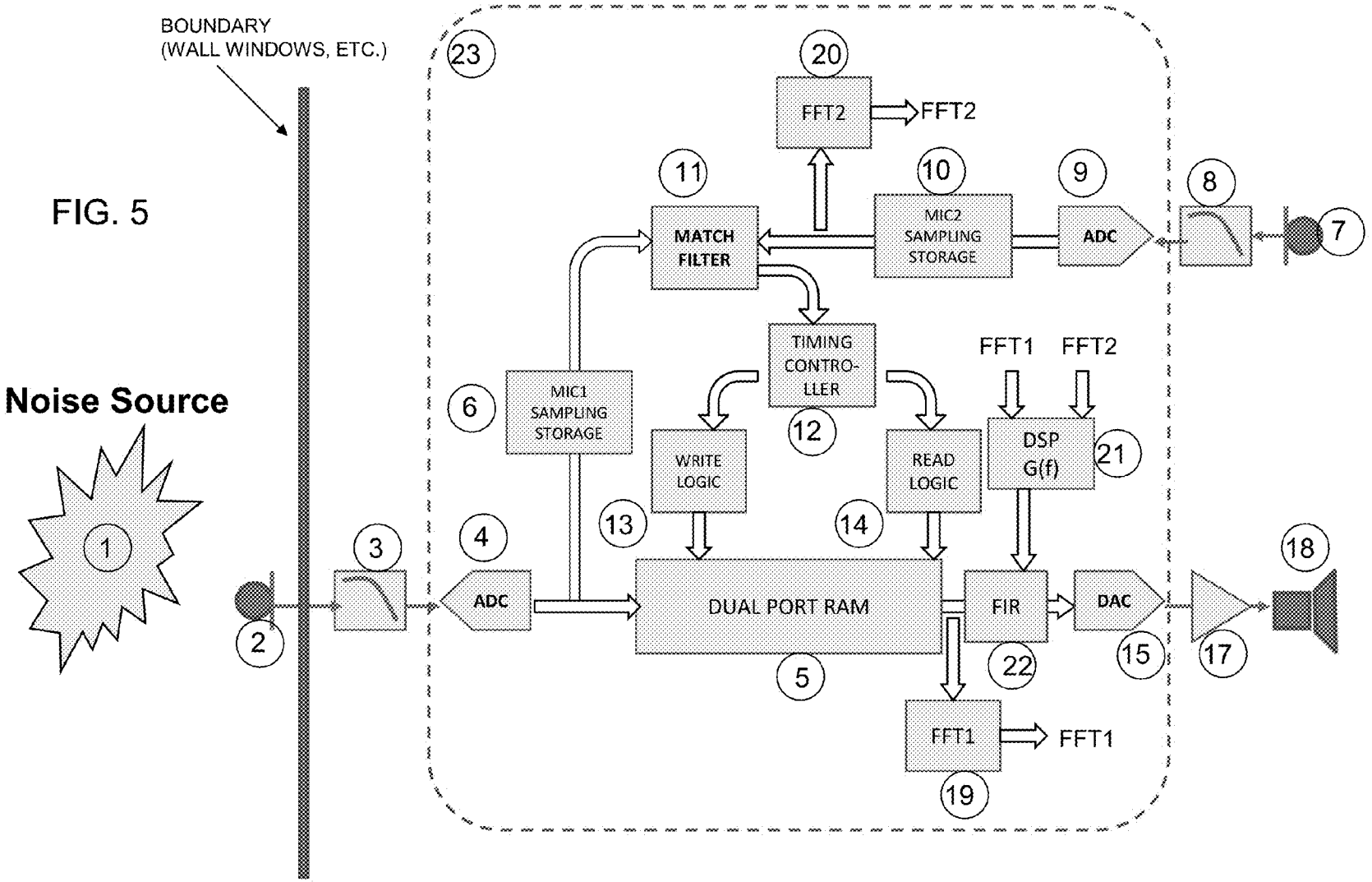
FIG. 5 is a schematic block diagram depicting another embodiment of an active noise reduction system with an indirect noise source input transmitted through a boundary.

As referred to in FIG. 5, in order to optimize in frequency domain, there are extra logic blocks added to account for the transfer function between the primary transducer 2 and secondary transducer 7, assuming the primary transducer 2 has the same frequency response with the secondary transducer 7.

Figure 6:
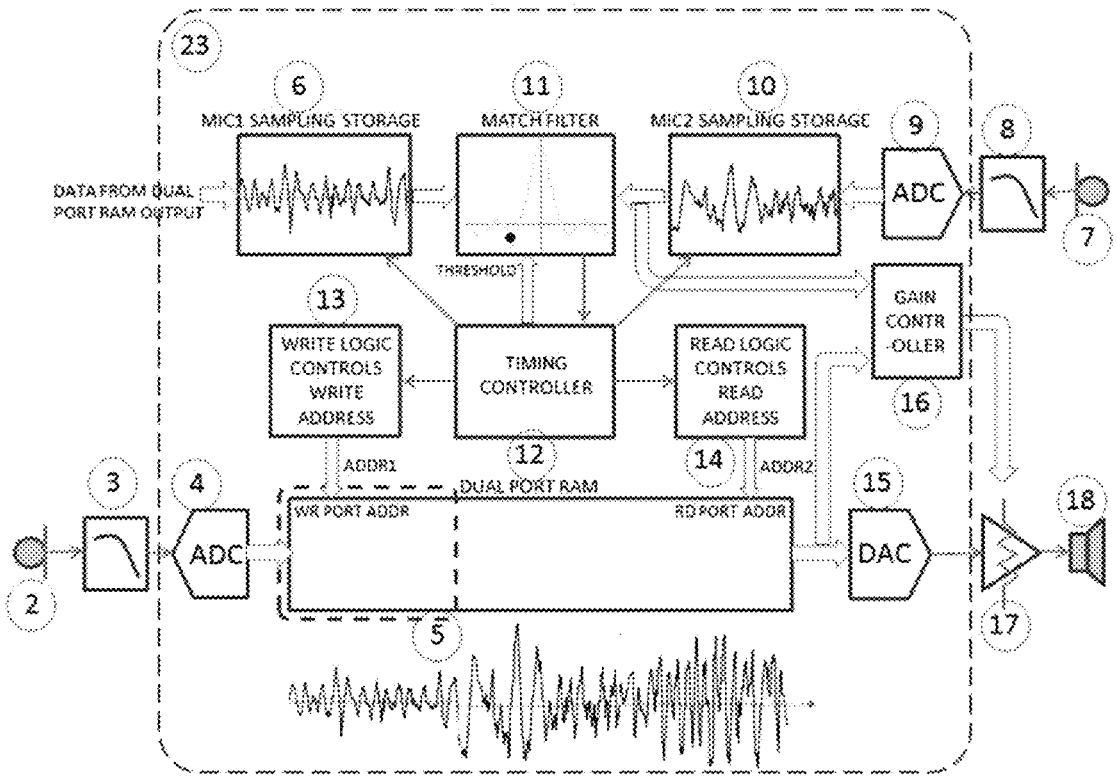
FIG. 6 is a schematic block diagram depicting yet another alternative embodiment of an active noise reduction system.
Figure 7:
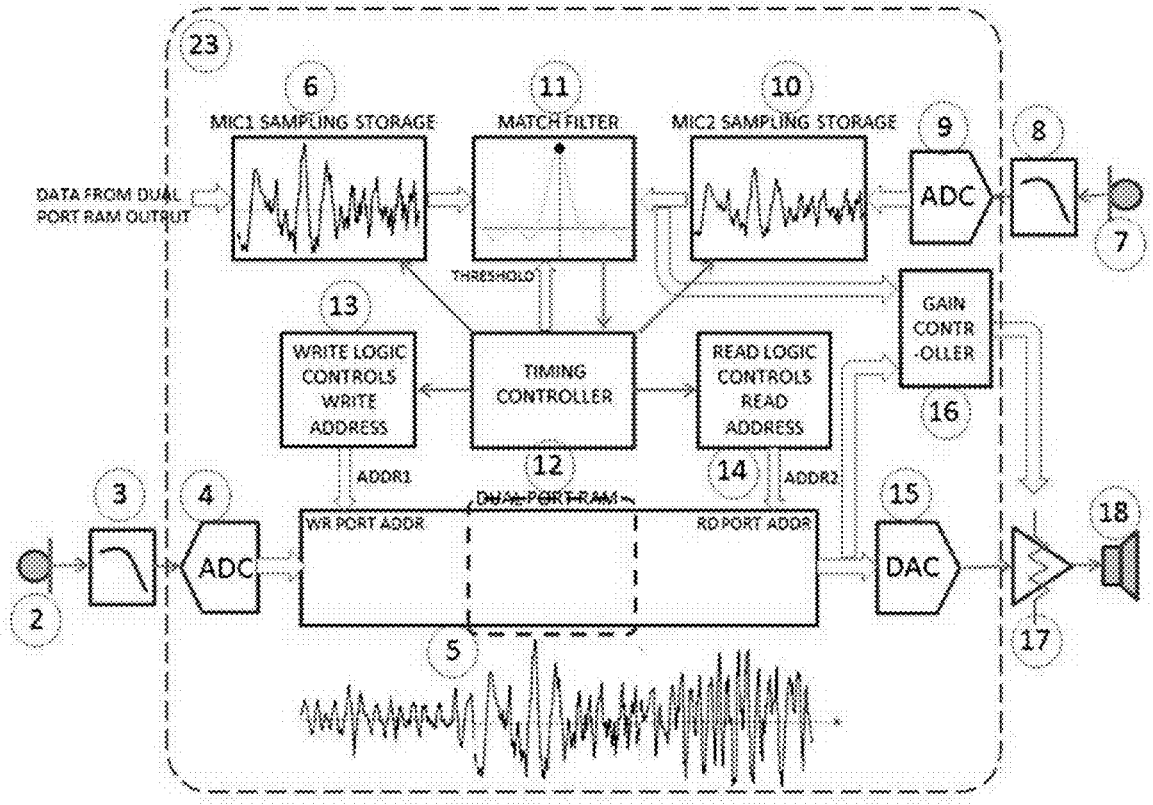
FIG. 7 is a schematic block diagram depicting yet another alternative embodiment of an active noise reduction system.
Figure 8:
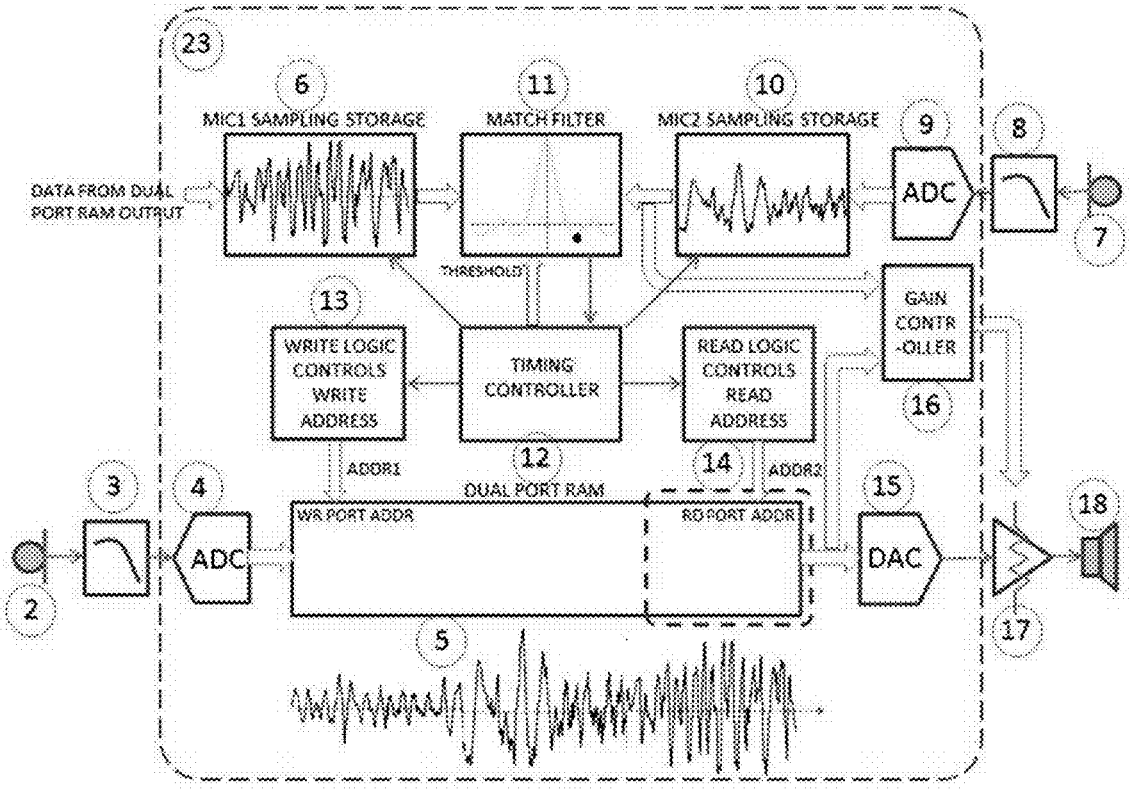
FIG. 8 is a schematic block diagram depicting yet another alternative embodiment of an active noise reduction system.

Turning now to FIGS. 6, 7, and 8, the steps are continued. Step 11: After steps 1 through 8, a FFT 1 block 19 is shown using samples from the main storage 5 output that are already aligned with samples from secondary transducer 7 in the time domain, while FFT2 block 20 is shown using samples from storage 10.

Step 12: A DSP block 21 is used to derive the transfer function between the primary transducer 2 and the secondary transducer 7, while the secondary transducer is the numerator. All the coefficients are stored in the Finite Impulse Response (FIR) block 22.

Step 13: The FIR block 22 is used to implement the transfer function on the output of the main storage 5 (dual-port-RAM), with its read control logic 14 capable of being adjusted with the delay of the additional FIR block, before entering the DAC 15. The resulting signal is amplified by gain stage 17 to drive the transducer 18 with opposite polarity, and now the generated output shall cancel out the noise signal perceived at secondary transducer 7.

While the invention has been described in terms of various specific embodiments, those skilled in the art will recognize that the invention can be practiced with modification within the spirit and scope of the claims. Additionally, features illustrated or described as part of one embodiment can be used in another embodiment to provide yet another embodiment such that the features are not limited to the specific embodiments described above. Thus, it is intended that the present invention cover all such embodiments and variations as long as such embodiments and variations come within the scope of the appended claims and their equivalents.

What is claimed is:

1. An active acoustic noise reduction system for reducing an effect of a noise source, comprising:

a noise source provided in a sound field;

at least one primary transducer provided in the sound field for sensing the noise source and providing an input signal corresponding to a sound from the noise source and noise in the sound field;

at least one anti-aliasing filter coupled to said at least one primary transducer for filtering said input signal and producing a filtered noise signal;

at least one analog-to-digital converter coupled to said at least one anti-aliasing filter for converting said filtered noise signal to a digital noise signal;

at least one digital-to-analog converter;

at least one dual port RAM that is large enough to store a portion of noise samples of said digital noise signal and wherein an input of said at least one dual port RAM is coupled to an output of said at least one analog-to-digital converter for receiving and storing the portion of the noise samples of said digital noise signal and an output of said at least one dual port RAM is coupled to an input of said at least one digital-to-analog converter;

at least one MIC1 sampling storage coupled to the output of said at least one analog-to-digital converter for receiving and storing samples of the digital noise signal;

at least one match filter coupled to said at least one MIC1 sampling storage;

at least one secondary transducer provided in a near sound field for sensing a sound propagated from said noise source and providing an input signal corresponding to the sound propagated from the noise source and noise in the sound field;

at least one MIC2 sampling storage coupled to said at least one secondary transducer and storing samples of the input signal corresponding to the sound propagated from the noise source and noise in the sound field and sensed by said at least one secondary transducer, and wherein an output of said at least one MIC2 sampling storage is coupled to said at least one match filter;

at least one gain ratio estimator coupled to the output of said at least one MIC2 sampling storage;

at least one gain setting device controlled by said at least one gain ratio estimator;

at least one third transducer coupled to an output of said at least one digital-to-analog converter through the at least one gain setting device;

wherein said at least one MIC1 sampling storage scans the stored portion of the noise samples of said digital noise signal through said at least one dual port RAM to produce a scanned noise signal and feeds the produced scanned noise signal into a first input of the at least one match filter;

wherein the at least one MIC2 sampling storage stores a fixed amount of the converted noise samples in digital format and feeds the converted noise samples into a second input of the at least one match filter;

wherein the at least one match filter synchronizes the stored samples of the digital noise signal gathered by the at least one primary transducer to a truncated signal of the fixed amount of the converted noise signal sensed by the at least one secondary transducer;

wherein the at least one gain ratio estimator compares a gain of the output of the at least one dual port RAM and a gain of the output of the at least one MIC2 sample storage to produce a ratio and feeds the ratio into the at least one gain setting device to drive the at least one third transducer;

wherein the at least one third transducer converts received and stored said digital noise signal in said at least one dual port RAM into acoustic energy with inverted polarity.

2. An active acoustic noise reduction system for reducing an effect of a noise source, comprising:

a noise source provided in a sound field;

at least one primary transducer provided in the sound field for sensing the noise source and providing an input signal corresponding to a sound from the noise source and noise in the sound field;

at least one anti-aliasing filter coupled to said at least one primary transducer for filtering said input signal and producing a filtered noise signal;

at least one analog-to-digital converter coupled to said at least one anti-aliasing filter for converting said filtered noise signal to a digital noise signal;

at least one digital-to-analog converter;

at least one dual port RAM that is large enough to store a portion of noise samples of said digital noise signal and wherein an input of said at least one dual port RAM is coupled to an output of said at least one analog-to-digital converter for receiving and storing the portion of the noise samples of said digital noise signal and an output of said at least one dual port RAM is coupled to an input of said at least one digital-to-analog converter;

at least one MIC1 sampling storage coupled to the output of said at least one analog-to-digital converter for receiving and storing samples of the digital noise signal;

at least one match filter coupled to said at least one MIC1 sampling storage and compare;

at least one secondary transducer provided in a near sound field for sensing a sound propagated from said noise source and providing an input signal corresponding to the sound propagated from the noise source and noise in the sound field;

at least one MIC2 sampling storage coupled to said at least one secondary transducer and storing samples of the input signal corresponding to the sound propagated from the noise source and noise in the sound field and sensed by said at least one secondary transducer, and wherein said at least one match filter is further coupled to an output of said at least one MIC2 sampling storage and compares the received and stored digital noise in the at least one dual port RAM to the stored samples of the input signal in the at least one MIC2 sampling storage for generating a comparison result;

a timing control logic coupled to said at least one match filter, and configured to calculate a delta time between the received and stored digital noise in the at least one dual port RAM, corresponding to the at least one primary transducer and the stored samples of the input signal in the at least one MIC2 sampling storage, corresponding to the at least one secondary transducer, according to the comparison result;

wherein the calculated delta time is applied operably to enable a calculation for a phase cancellation of the input signal sensed by the at least one primary transducer;

at least one gain ratio estimator coupled to the output of said at least one MIC2 sampling storage;

at least one gain setting device controlled by said at least one gain ratio estimator;

at least one third transducer coupled to an output of said at least one digital-to-analog converter through the at least one gain setting device;

wherein the at least one MIC1 sampling storage scans a stored portion of the noise samples of said digital noise signal through the at least one dual port RAM to produce a scanned noise signal and feeds the produced scanned noise signal into a first input of the at least one match filter;

wherein the at least one MIC2 sampling storage stores a fixed amount of the converted noise samples in digital format and feeds the converted noise samples into a second input of the at least one match filter;

wherein the at least one match filter synchronizes the stored samples of the digital noise signal gathered by the at least one primary transducer to a truncated signal of the fixed amount of the converted noise signal sensed by the at least one secondary transducer;

wherein the at least one gain ratio estimator compares a gain of the output of the at least one dual port RAM and a gain of the output of the at least one MIC2 sample storage to produce a ratio and feeds the ratio into the at least one gain setting device to drive the at least one third transducer;

wherein the at least one third transducer converts the received and stored said digital noise signal in said at least one dual port RAM into acoustic energy with inverted polarity.

* * * * *